US008641583B2

(12) United States Patent
Chen

(10) Patent No.: US 8,641,583 B2
(45) Date of Patent: Feb. 4, 2014

(54) BOXING TRAINING DEVICE

(76) Inventor: Tina Chen, Taichung (TW)

( * ) Notice: Subject to any disclaimer, the term of this patent is extended or adjusted under 35 U.S.C. 154(b) by 197 days.

(21) Appl. No.: 13/252,203

(22) Filed: Oct. 4, 2011

(65) Prior Publication Data

US 2013/0085044 A1 Apr. 4, 2013

(51) Int. Cl.
*A63B 21/00* (2006.01)

(52) U.S. Cl.
USPC ..... 482/83; 482/87; 482/90

(58) Field of Classification Search
USPC ..... 482/83, 84, 85, 86, 87, 88, 89, 90
See application file for complete search history.

(56) References Cited

U.S. PATENT DOCUMENTS 547,731 A * 10/1895 MacLean ..... 482/85
1,890,696 A * 12/1932 Rosenhahn ..... 482/90
2006/0191089 A1* 8/2006 Gracindo et al. ..... 15/144.4

* cited by examiner

*Primary Examiner* — Jerome W Donnelly
(74) *Attorney, Agent, or Firm* — Banger Shia

(57) ABSTRACT

The boxing training device of the present invention includes two hollow elastic elements which locate on two different positions. The boxing training device also includes two slidable and rigid sliders. The slider can be moved into the elastic element so that the elastic element can be limited by the slider. As such, the whole device does not sway when transporting without disassembling. Also, said device can provide a variety of way to use.

7 Claims, 8 Drawing Sheets

BOXING TRAINING DEVICE

BACKGROUND OF THE INVENTION

1. Field of the Invention

The present invention relates to a boxing training device, more particularly to an adjustable and safe device that the extent of sway can be adjusted and the way to use is changeable.

2. Description of the Prior Art

A typical boxing training device is as disclosed in TW510239. The boxing training device includes a base, a shaft disposed on the base, and a hit portion disposed on the upper end of the shaft. Wherein, an elastic element, such as a spring, is disposed between the base and the shaft.

But the device as mentioned above can sway at only one mode so that the device can not provides more ways to use. Also, the device is easy to sway when transported or moved without disassembling so that it makes transporting more dangerous and inconvenient.

The present invention, therefore, makes improvements on the disadvantages as mentioned above.

SUMMARY OF THE INVENTION

The main object of the present invention is to provide a training device which is adjustable and safe to use.

To achieve the above and other objects, a boxing training device of the present invention includes a base portion, a support portion and a hit portion, wherein the support portion includes a hollow shaft, two sliders, and two hollow elastic elements. A longitudinal axis is defined along the extending direction of the shaft. Two ends of the shaft connected to the two elastic elements respectively. Two slots which extend along the longitudinal axis locate on wall of the shaft. The two slots locate near two opposite ends of the shaft. The sliders are columns and are slidably disposed in the shaft. The sliders have fixing members and part of the fixing elements is exposed out of the shaft. The fixing members connect to the sliders through the slots. The slider can be moved into the elastic element in order to limit the action of the elastic element.

Thereby, the extent of sway is able to be adjusted, so the way of use is changeable. Also, the device may not sway when all the elastic elements are fixed so that transporting or moving the device without disassembling may be much easier and safer.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
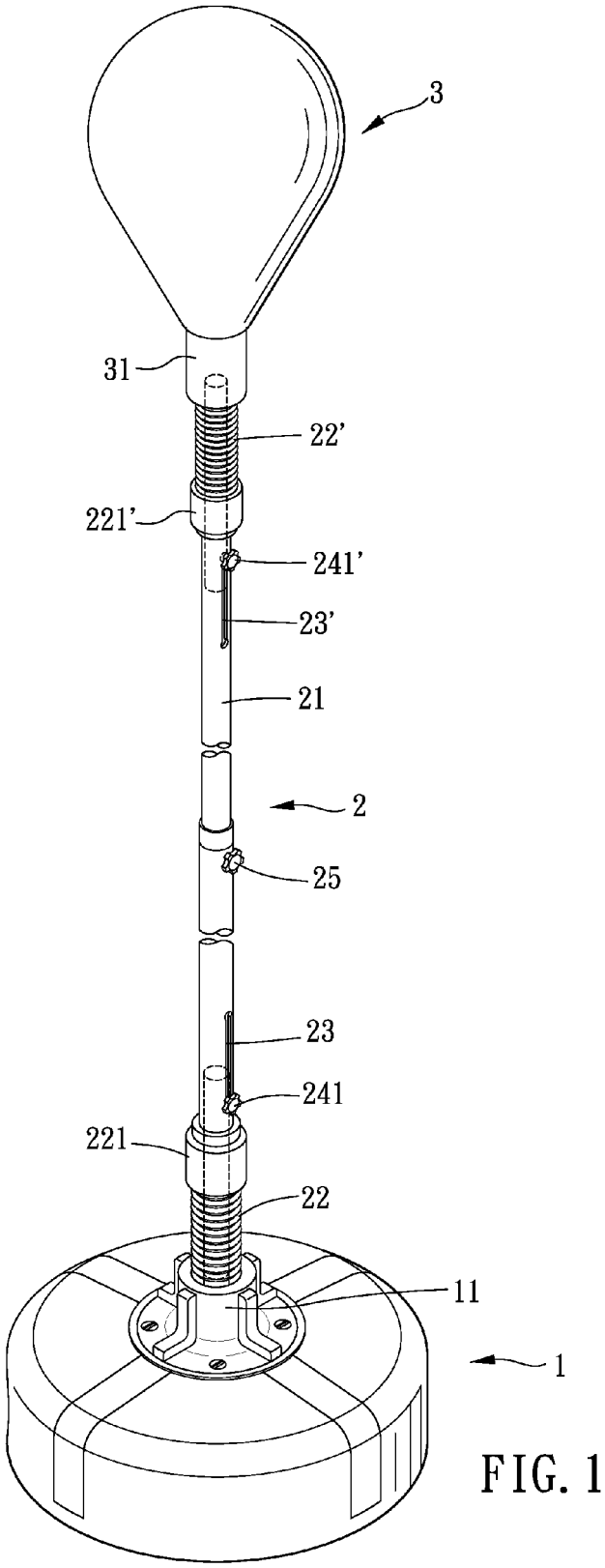
FIG. 1 is a stereogram showing a boxing training device of the present invention.
Figure 2:
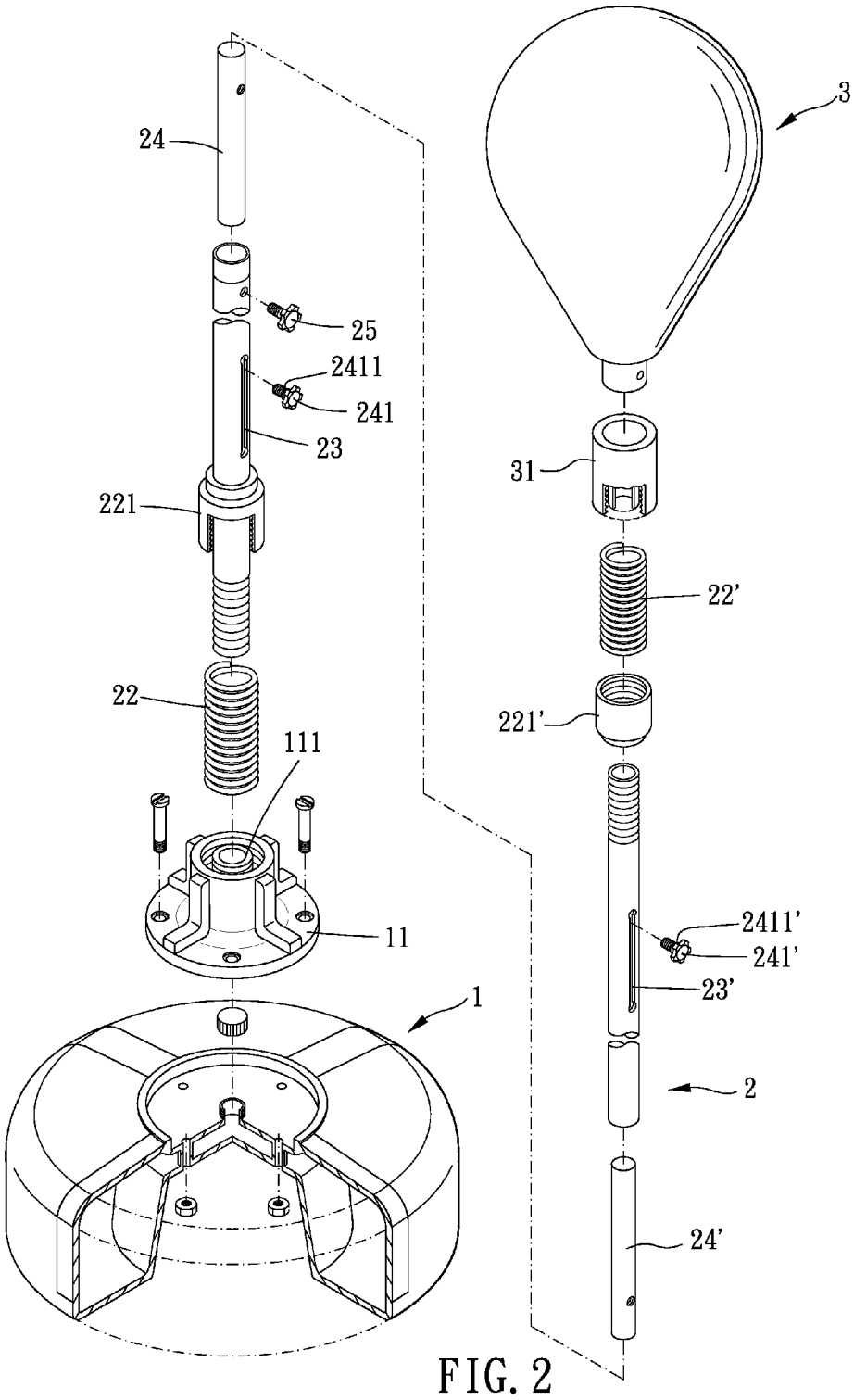
FIG. 2 is a breakdown drawing showing a boxing training device of the present invention.

Please refer to FIG. 1 and FIG. 2, the boxing training device includes a base portion 1, a support portion 2, and a hit portion 3.

The base portion 1 has lower fixing element 11 which is a hollow tube with a blind end. Said blind end on the lower fixing element 11 locates on an end near the base portion 1. The lower fixing element 11 is fixed to the base portion 1 by screws. The lower fixing element 11 is threaded on its inner wall. Moreover, an inner tube 111 is disposed in the lower fixing element 11.

The support portion 2 includes a shaft 21, a first slider 24, a second slider 24', a hollow first elastic element 22 and a hollow second elastic element 22'. A longitudinal axis is defined along the extending direction of the shaft 21. The shaft 21 of the support portion 2 is composed of two hollow tubes having different external diameters, and the hollow tube with smaller diameter is partly received in adjacent hollow tube. The hollow tube with larger diameter has a threaded hole on its wall. The shaft 21 has an adjustment element 25 which is used for adjusting a length of the shaft 21. One end of the adjustment element 25 has a bolt to be engaged to the threaded holes of the outer tubes of the shaft 21. One end of the shaft 21 is engaged to the first elastic element 22, and the other end of the shaft 21 is engaged to the second elastic element 22'. A protection element 221, 221' is disposed around the connection between each elastic element 22, 22' and the shaft 21. A first slot 23 and a second slot 23' are formed on different positions on the shaft 21 wall respectively, and each slot 23, 23' extends along the longitudinal axis. Moreover, the two slots 23, 23' locate on two ends of the shaft 21 respectively. Each of the first slider 24 and the second slider 24 is a column and is slidably received in the shaft 21. The first slider 24 has a first fixing member 241, and the second slider 24' has a second fixing member 241'. Each of the fixing members 241, 241' is partly exposed out of the shaft 21. Each slider 24, 24' has a threaded hole, and each fixing member 241, 241' has a bolt at one end. The first fixing member 241 is engaged to the threaded hole of the first slider 24 via the first slot 23, and the second fixing member 241' is engaged to the threaded hole of the second slider 24' via the second slot 23'. Wherein, each fixing member 241, 241' has a protrusion 2411, 2411' whose diameter is larger than the diameter of the bolt of the fixing member 241, 241'. Each slot 23, 23' has ends whose widths are not smaller than the diameter of the protrusion 2411, 2411' of the corresponding fixing member 241, 241', and a width between the two ends of each slot 23, 23' is smaller than the diameter of the protrusion 2411, 2411' of the corresponding fixing member 241, 241'.

The hit portion 3 has an upper fixing element 31 which is a hollow tube with a blind end. The blind end locates on an end on the upper fixing element 31 near the hit portion 3. The inner wall of the upper fixing element 31 is threaded. An inner tube is disposed in the upper fixing element.

The first elastic element 22 is screwed to the inner wall of the lower fixing element 11, and the second elastic element 22' is screwed to the inner wall of the upper fixing element 31. The first slider 24 is able to be received in the inner tube of the lower fixing element 11, and the second slider 24' is able to be received in the inner tube of the upper fixing element 31.

Figure 3:
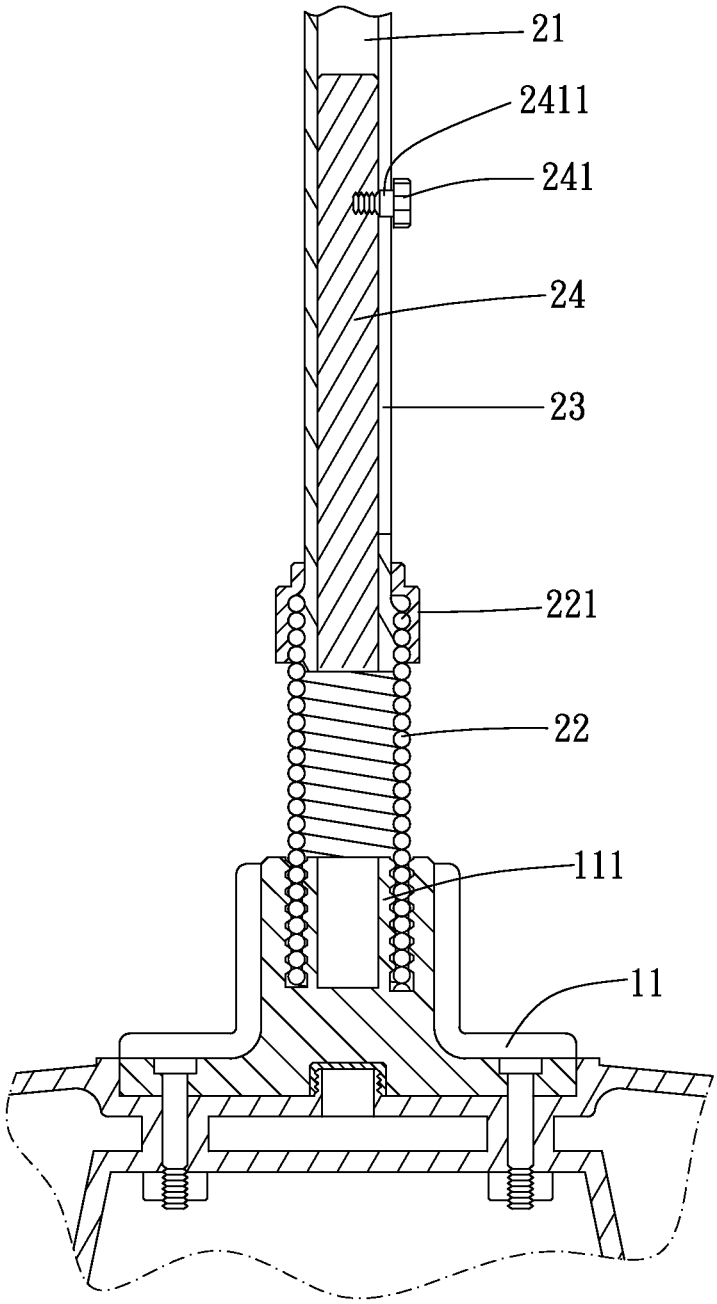
FIG. 3 is a partial enlargement perspective view showing a first condition of using of the present invention.

About the action mechanisms of the sliders 24, 24', the first slider 24 is considered as an example. Please refer to FIG. 3 for the first condition of using of the present invention. When the first slider 24 is moved out of the first elastic element 22, the first elastic element 22 is able to sway. For being fixed better, the first fixing member 241 is screwed to the first slider 24 remote from the first elastic element 22 at an end of the first slot 23. And then, the protrusion 2411 of the first fixing member 241 is embedded to the wilder end of the first slot, wherein the wilder end is away from the first elastic element 22.

Figure 4:
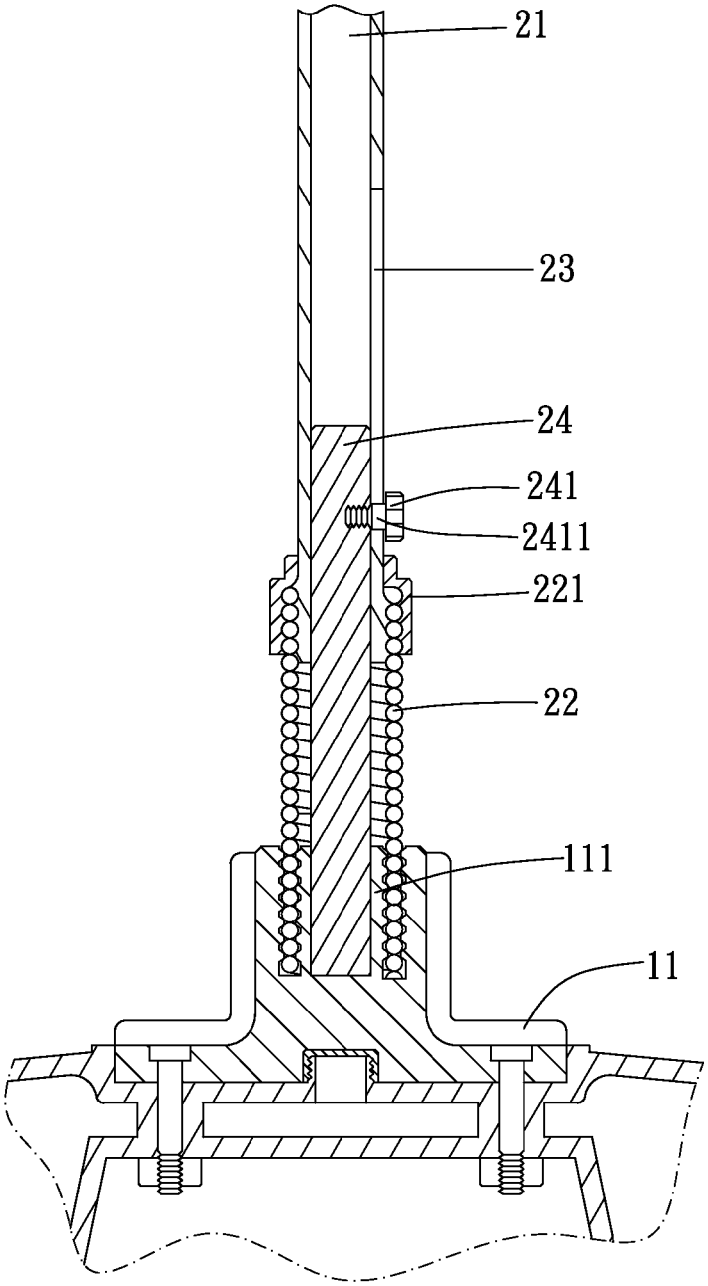
FIG. 4 is a partial enlargement perspective view showing a second condition of using of the present invention.

Please refer to FIG. 4 for the second condition of using of the present invention. When the first slider 24 is moved into the first elastic element 22, the first elastic element 22 is not able to sway. For being fixed better, the first fixing member 241 is screwed to the first slider 24 near the first elastic element 22 at an end of the first slot 23. And then, the protrusion 2411 of the first fixing member 241 is embedded to the wilder end of the first slot 23, wherein the wilder end is near the first elastic element 22.

The action mechanism of the second slider 24', the second slot 23', and the second elastic element 22' is similar to the example mentioned above.

In respect of the usage, please refer to FIG. 5 to FIG. 8 for different modes of operation of the present invention.

Figure 5:
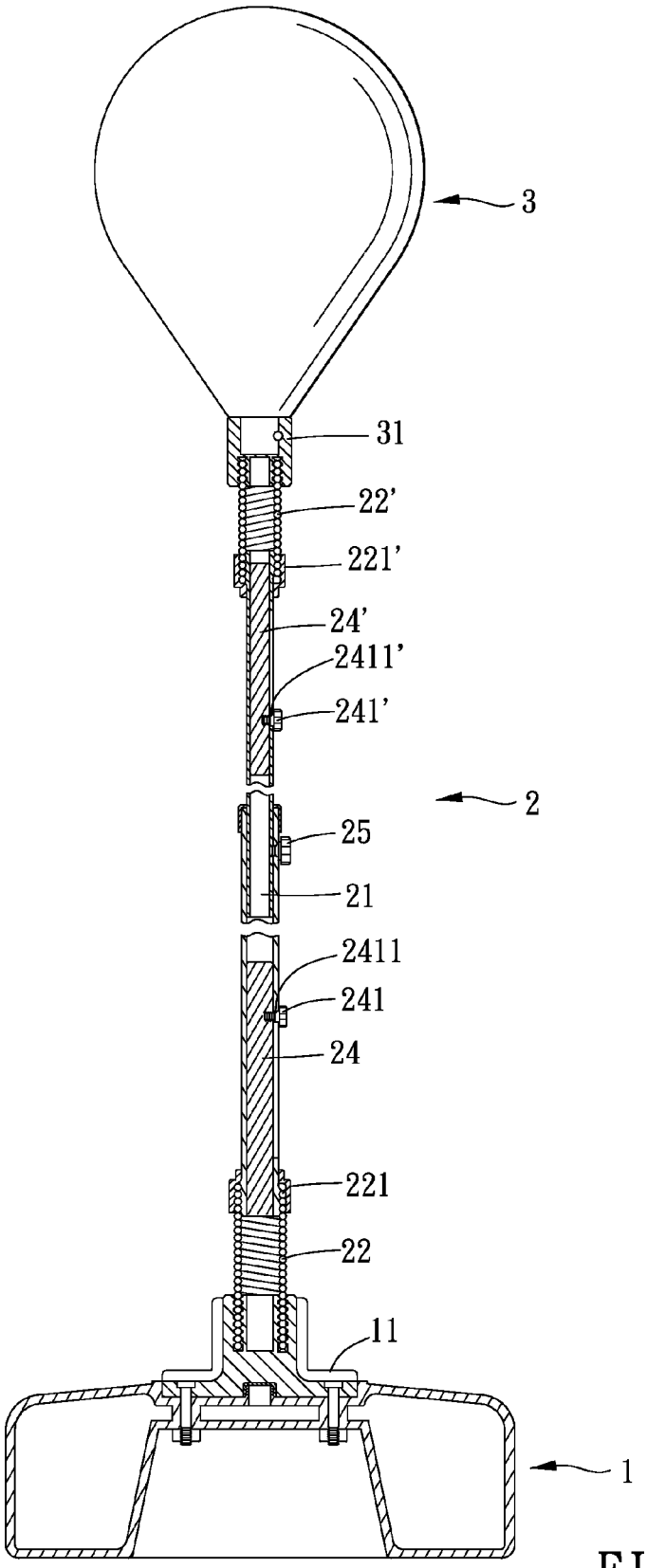
FIG. 5 is a perspective view showing a first mode of operation of the present invention.

Please refer to FIG. 5 for the first mode of operation of the present invention, the first elastic element 22 and the second elastic element 22' are both not fixed and are free to sway. Under this condition, the extent of sway is larger and the rebound time of the hit portion is longer. In other words, the strength of rebound is smaller.

Figure 6:
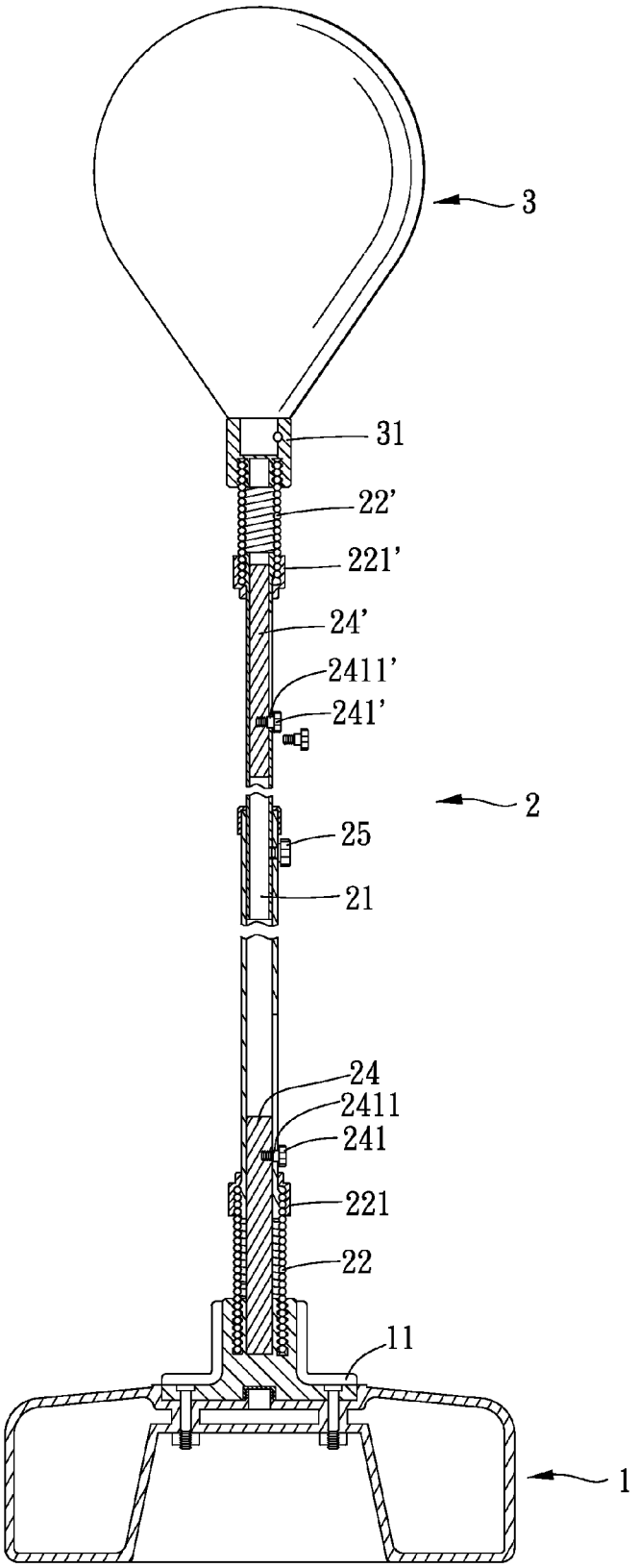
FIG. 6 is a perspective view showing a second mode of operation of the present invention.

Please refer to FIG. 6 for the second mode of operation of the present invention, the second elastic element 22' is fixed, but the first elastic element 22 is not fixed and is free to sway. Under this condition, the extent of sway and the rebound time of the hit portion are moderate.

Figure 7:
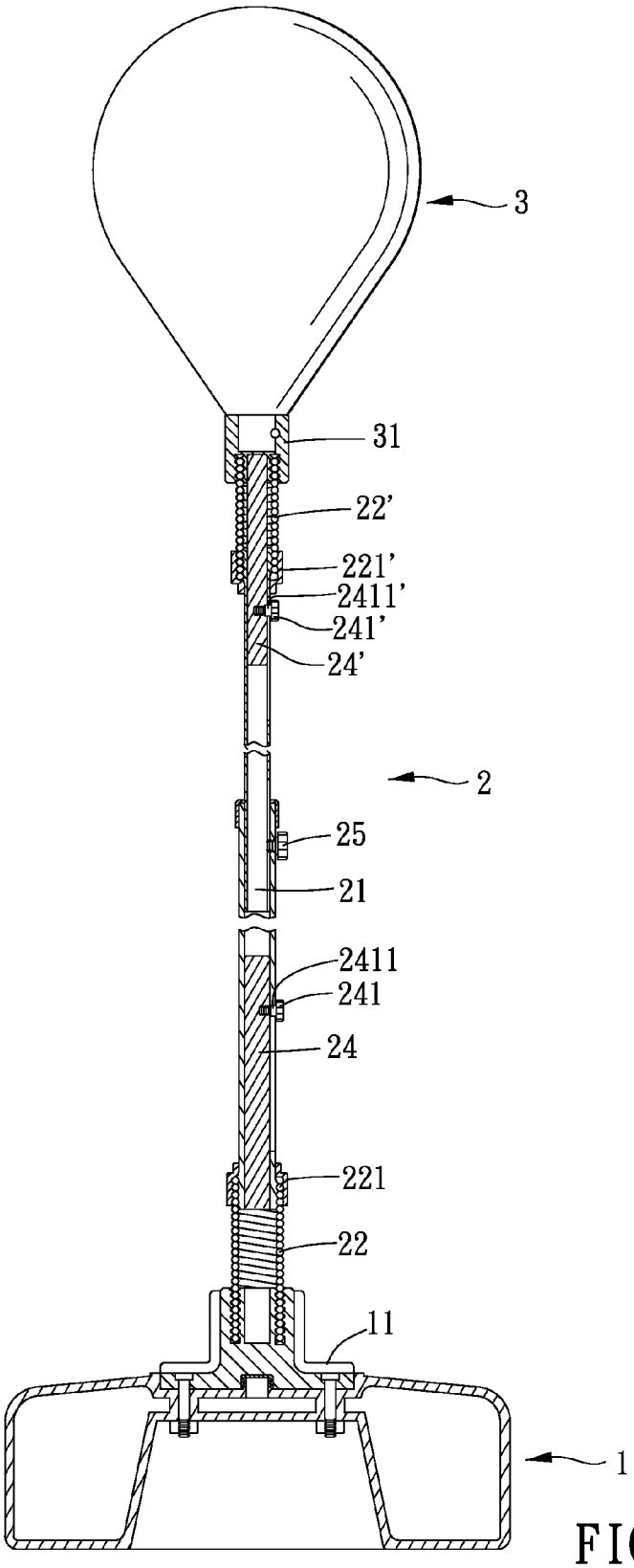
FIG. 7 is a perspective view showing a third mode of operation of the present invention.

Please refer to FIG. 7 for the third mode of operation of the present invention, the first elastic element 22 is fixed, but the second elastic element 22' is not fixed and is free to sway. Under this condition, the extent of sway is smaller and the rebound time of the hit portion is shorter. In other words, the strength of rebound is larger.

Figure 8:
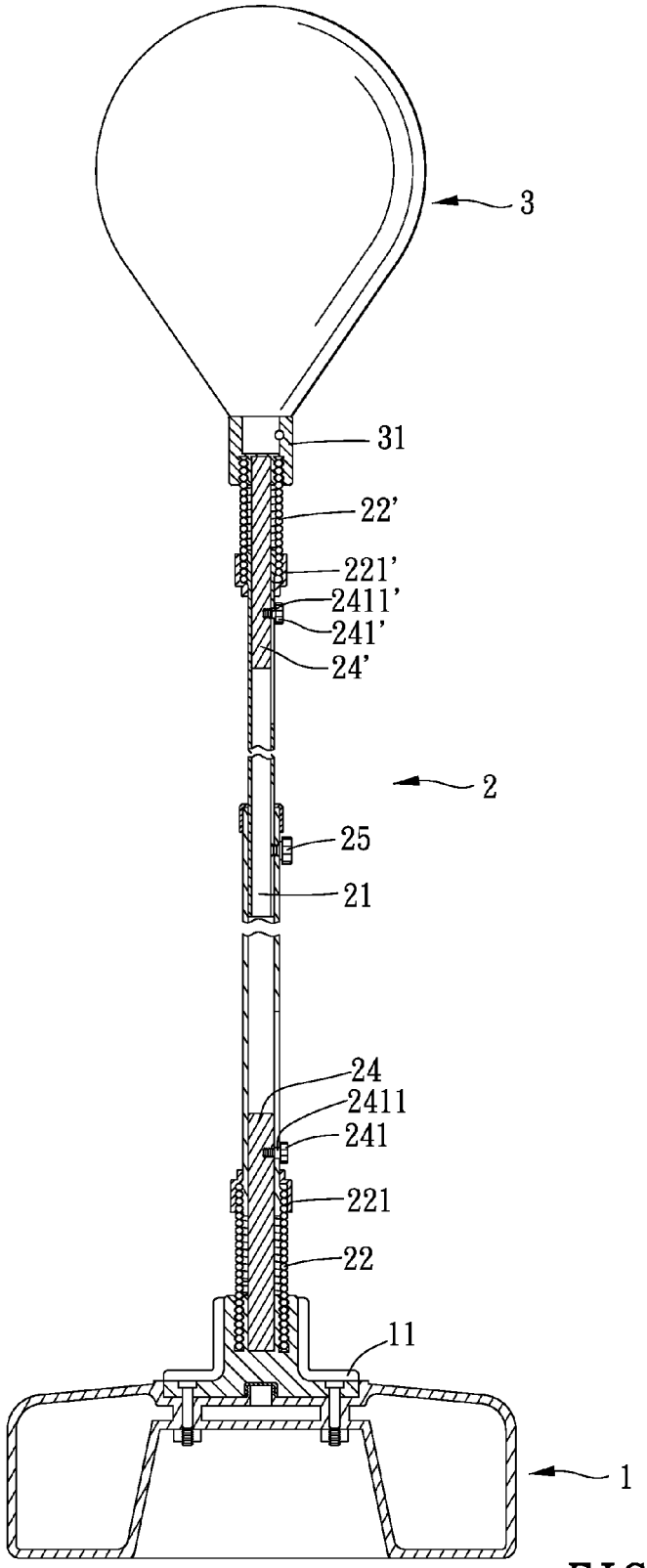
FIG. 8 is a perspective view showing a forth mode of operation of the present invention.

Please refer to FIG. 8 for the forth mode of operation of the present invention, both the first elastic element 22 and the second elastic element 22' are fixed. Under this condition, the support portion 2 and the hit portion 3 do not sway when transporting or moving without disassembling. On the other hand, this mode prevents rebounding of the hit portion when the device is hit accidentally so that the safety is improved.

In conclusion, the present invention has the following advantages:

1. The extent of the sway is adjustable so that more ways of using are provided.
2. The height of the device is adjustable.
3. Transporting becomes easier and safer.

What is claimed is:

1. A boxing training device, comprising:

a base portion, having a lower fixing element;

a support portion, comprising a hollow shaft, a first slider, and a hollow first elastic element, a longitudinal axis being defined along an extending direction of the shaft, the first elastic element being disposed on the shaft, a first slot being formed on a wall of the shaft, the first slot extending along the longitudinal axis, the first slider being a column and being received in the shaft, the first slider being able to slide between a first position and a second position, the first slider being able to be received in the first elastic element in order to limit the action of the first elastic element to prevent the elastic element from pivoting around radial directions of the shaft, the first slider having a first fixing member which is exposed partly out of the shaft, the first fixing member being able to slide in the first slot with the first slider;

a hit portion, having an upper fixing element;

wherein one end of the support portion being connected to the lower fixing element of the base portion, the other end of the support portion being connected to the upper fixing element of the hit portion.

2. The boxing training device of claim 1, wherein the first elastic element is connected to one end of the shaft, a hollow second elastic element is connected to the other end of the shaft, a second slot is formed on the wall of the shaft, a second slider is a column and is received in the shaft, the second slider has a second fixing member which is exposed partly out of the shaft, the second fixing member is able to slide in the second slot with the second slider, the second slider is able to slide between a third position and a fourth position, the second slider is able to be received in the second elastic element in order to limit the action of the second elastic element.

3. The boxing training device of claim 2, the lower fixing element of the base portion being a hollow column and having a blind end, an inner wall of the lower fixing element being threaded and being screwed with the first elastic element, a inner tube being disposed in the lower fixing element, the first slider being received in the inner tube of the lower fixing element.

4. The boxing training device of claim 2, the upper fixing element of the hit portion being a hollow column and having a blind end, an inner wall of the upper fixing element being threaded and being screwed with the second elastic element, a inner tube being disposed in the upper fixing element, the second slider being received in the inner tube of the upper fixing element.

5. The boxing training device of claim 2, the shaft of the support portion being composed of at least two hollow tubes having different external diameters, the hollow tubes with smaller diameter being partly received in adjacent hollow tubes, the outer hollow tubes having threaded holes on a wall of the outer hollow tubes, the shaft having at least one adjustment element which is used for adjusting a length of the shaft, one end of the adjustment element having a bolt to be screwed with the threaded holes of the outer tubes of the shaft.

6. The boxing training device of claim 2, the first slider and the second slider having a threaded hole respectively, one end of the first fixing member having a bolt, one end of the second fixing member having a bolt, the first fixing member being screwed to the first slider via the first slot, the second fixing member being screwed to the second slider through the second slot.

7. The boxing training device of claim 6, each of the first fixing member and the second fixing member having a protrusion whose diameter is larger than a diameter of the bolt of the corresponding fixing member, each of the first slot and the second slot having ends whose widths are not smaller than the diameter of the protrusion of the corresponding fixing member, a width between the two ends of each slot being smaller than the diameter of the protrusion of the corresponding fixing member.

* * * * *